US008840959B2

(12) United States Patent
Bentley

(10) Patent No.: US 8,840,959 B2
(45) Date of Patent: Sep. 23, 2014

(54) CAMOUFLAGE BRANDING SYSTEM AND METHOD

(71) Applicant: Krow Innovation, LLC, Nampa, ID (US)

(72) Inventor: James K. Bentley, Eagle, ID (US)

(73) Assignee: Adaptive Graphx LLC, Nampa, ID (US)

( * ) Notice: Subject to any disclaimer, the term of this patent is extended or adjusted under 35 U.S.C. 154(b) by 0 days.

(21) Appl. No.: 13/899,346

(22) Filed: May 21, 2013

(65) Prior Publication Data

US 2014/0072708 A1 Mar. 13, 2014

Related U.S. Application Data

(62) Division of application No. 13/612,211, filed on Sep. 12, 2012, now Pat. No. 8,507,077.

(51) Int. Cl.

| | |
|---|---|
| ***B05D 5/00*** | (2006.01) |
| ***B41M 3/00*** | (2006.01) |
| ***F41H 3/00*** | (2006.01) |

(52) U.S. Cl.

CPC . *B41M 3/008* (2013.01); *F41H 3/00* (2013.01)
USPC ..... 427/261; 427/145; 427/256; 427/262; 427/265

(58) Field of Classification Search

CPC ..... B05D 1/36; B41M 1/12; B44C 1/00; F41A 35/04
USPC ..... 427/145, 256, 261, 262, 265
See application file for complete search history.

(56) References Cited

U.S. PATENT DOCUMENTS

| | | | |
|---|---|---|---|
| 2,104,790 | A | 1/1938 | Casto |
| 2,340,514 | A | 2/1944 | Dicks |

(Continued)

FOREIGN PATENT DOCUMENTS

| | | |
|---|---|---|
| EP | 0822011 | 2/1998 |
| FR | 2700732 | 7/1994 |
| JP | 7108216 | 4/1995 |

OTHER PUBLICATIONS

Office Action dated Dec. 6, 2012 issued in U.S. Appl. No. 13/612,211.

(Continued)

*Primary Examiner* — Michael Cleveland
*Assistant Examiner* — Xiao Zhao
(74) *Attorney, Agent, or Firm* — Parsons Behle & Latimer

(57) ABSTRACT

A camouflage system includes a layer of an adhesion promoter so paint will adhere to the surface of an article and a first layer of paint applied to the surface on top of the adhesion promoter. A second layer of paint of a different color is applied to a portion of the first layer of paint. The second layer of paint may be in the form of a design, symbol, brand, logo, mark, and/or name. A multi-color layer is then applied to the surface of the article over the layers of paint. The multi-color layer may be a camouflage ink pattern. A clear coat may be applied over the multi-color layer. The multi-color layer affects the visual appearance of the second layer of paint. The second layer of paint may be visible at one viewing angle and may be less visible or non-visible at a different viewing angle.

14 Claims, 3 Drawing Sheets

(56) References Cited

U.S. PATENT DOCUMENTS

| | | | | |
|---|---|---|---|---|
| 4,259,375 | A | 3/1981 | Vassiliou | |
| 4,837,056 | A | 6/1989 | Easley | |
| 4,868,019 | A * | 9/1989 | Knickerbocker | 428/17 |
| 7,507,285 | B2 | 3/2009 | Venturini et al. | |
| 7,682,661 | B2 | 3/2010 | Lauer | |
| 7,854,965 | B2 | 12/2010 | Tomasella et al. | |
| 8,062,736 | B1 * | 11/2011 | Coolong et al. | 428/195.1 |
| 8,071,170 | B2 | 12/2011 | Kamimori et al. | |
| 8,104,215 | B2 | 1/2012 | Lauer | |
| 8,128,994 | B1 | 3/2012 | Folck et al. | |
| 2002/0094381 | A1 * | 7/2002 | Niemuth et al. | 427/256 |
| 2004/0201847 | A1 * | 10/2004 | Yamanouchi et al. | 356/402 |
| 2005/0005339 | A1 * | 1/2005 | Johnson | 2/69 |
| 2005/0048304 | A1 * | 3/2005 | Jones | 428/542.2 |
| 2009/0017269 | A1 | 1/2009 | Johnson | |
| 2011/0265953 | A1 | 11/2011 | Korell | |

OTHER PUBLICATIONS

Office Action dated Jan. 29, 2013 issued in U.S. Appl. No. 13/612,211.

* cited by examiner

CAMOUFLAGE BRANDING SYSTEM AND METHOD

CROSS-REFERENCE TO RELATED APPLICATIONS

This application is a divisional of U.S. patent application Ser. No. 13/612,211, now U.S. Pat. No. 8,507,077, filed Sep. 12, 2012, and entitled "Camouflage Branding System and Method" the disclosure of which is hereby incorporated by reference in its entirety.

BACKGROUND

1. Field of the Disclosure

The embodiments described herein relate to a camouflage system that may be applied to an article that may include a design, brand, logo, name, symbol, and/or mark incorporated into the camouflage system and a method of using the camouflage system. The design, brand, logo, name, symbol, and/or mark positioned below a camouflage layer of the system may affect the appearance of the camouflage layer. The camouflage layer over the design, brand, logo, name, symbol, and/or mark may affect the visual appearance so that the design, brand, logo, name, symbol, and/or mark is highly visible at one viewing angle and less visible or non-visible at a different viewing angle.

2. Description of the Related Art

Water transfer printing has been used to apply an ink pattern, such as camouflage pattern, to the surface of an article, such as to the surface of components of a firearm. The ink pattern is formed onto a water soluble film or backing, such as a polyvinyl alcohol (PVA) based film. The ink pattern may include clear portions randomly located throughout the pattern that permits the color on the surface to be viewable. For example, many typical camouflage patterns consist of various randomly positioned colors on the PVA film separated portions of the PVA film not including any ink. The water soluble film containing the ink pattern is placed onto the surface of a water bath causing the backing to dissolve leaving the ink pattern suspended on the surface of the water bath. An article may then be dipped into the water bath wherein the suspended ink pattern is transferred the surface of the article.

Prior to dipping the article in the water bath, the surface of the article is prepared so that the ink pattern adheres to the surface. For example, most commercially available camouflage patterns dictate that a specific color of base paint be applied to the surface of the article so that the camouflage layer when applied to the surface of the article has the intended appearance. Typically, an adhesion promoter, primer, and/or seal coat needs to be added to the surface of the article prior to the application of the base paint so that the base paint adheres to the surface. Any application of a substance to a surface of an article that promotes the adherence of a base paint may be considered an adhesion promoter, primer, and/or seal coat.

One potential problem with conventional camouflage systems is using the camouflage pattern along with providing a brand or logo on the article. The majority of camouflage systems do not permit the incorporation of a brand or logo with the camouflage pattern. Instead, a masking technique may be used to create a brand or logo by prohibiting the camouflage pattern from adhering to the masked area. The brand or logo is not incorporated into the pattern, but rather created by the absence of the pattern. If a brand or logo is inserted into the camouflage pattern itself, the brand or logo may not be positioned or orientated in the proper manner due to dipping the surface of an article into ink that is suspended on a water bath. The ink pattern is usually allowed to orientate itself onto the surface which may locate the brand or logo in a less than desired location or at a less than desired orientation.

A sticker in the form of a brand or logo may be applied to the surface of an article after applying a camouflage pattern to the surface. However, such a sticker is applied above the camouflage pattern covering up and obscuring the camouflage pattern. Stickers applied to over the camouflage pattern to brand the component may detract from the camouflage pattern itself

SUMMARY

The present disclosure is directed to camouflage system and method that overcomes some of the problems and disadvantages discussed above.

One embodiment is a camouflage system that comprises an article having a surface and a first layer applied on the surface of the article. The first layer may be a primer, adhesion promoter, seal coat, or any application that promote the adherence of paint to the surface. The system includes a second layer that covers at least a portion of the surface. The second layer is a paint of a first color. As used herein, the term "paint" refers to any tint, stain, ink, dye, pigment, or other covering substance used to change the appearance of a surface or object. The system includes a third layer covering at least a portion of the second layer. The third layer is a paint of a second color that has a visual appearance and is visually distinct from the second layer. The system includes a fourth layer that covers the second and third layers. The fourth layer is a multi-color layer that alters the visual appearance of the third layer. The first color of the second layer affects the visual appearance of the fourth layer. The third layer blocks the effect of the first color of the second layer. The system includes a fifth layer that covers the fourth layer. The fifth layer being a clear coat.

The fourth layer of the system may be a camouflage layer. The first color of the second layer of the system may be determined based on the camouflage layer. The article of the system may be a component of a firearm. The third layer of the system may be in the form of a design, mark, brand, logo, symbol, and/or name. The third layer of the system may be a metallic paint. The third layer of the system may be a mixture of metallic paint and pearl paint. The visual appearance of the third layer may change by movement of the surface between two angles of orientation while the fourth layer is visible at both angles of orientation. The altered visual appearance of the third layer may be non-uniform over the entire third layer.

One embodiment is a method of camouflaging an article. The method comprises applying a first paint of a first color to at least a portion of a surface of the article, applying a second paint of a second color to cover a portion of the first paint, and applying a multi-color layer to at least the portion of the surface of the article, the multi-color layer covering the second paint and the first paint not covered by the second paint. The multi-color layer of the method may be applied by a water transfer printing process. The first color may affect a visual appearance of the multi-color layer and the second color may block the effect of the first color on the visual appearance of the multi-color layer.

The method may comprise applying a seal coat to the surface of the article prior to applying the first paint and applying a clear coat to the surface of the article after applying the multi-color layer. The multi-color layer may be a camouflage pattern. The application of the camouflage pattern may alter a visual appearance of the second paint. The altering of the second paint may be non-uniform across the second paint. The method may comprise dissolving a backing away from the camouflage pattern and dipping the surface of the article into ink comprising a camouflage pattern, the ink being suspended on top of a water bath. The method may comprise permitting the ink to randomly orient itself onto the surface of the article. The method may include applying the second paint through a stencil. The stencil may be formed to comprise a mark, logo, brand, design, symbol, and/or name.

The second color of the method may contrast with the first color. The second paint may be metallic paint or a mixture of metallic paint and pearl paint, or some other paint with reflective, refractive, diffractive, or diffusive transmission properties. The second paint may be visible when the article is positioned at a first viewing angle. The method may include rotating the article to a second viewing angle so that the second paint is less visible, but the multi-color laying being visible at both the first viewing angle and the second viewing angle. The method may include rotating the article to a second viewing angle so that the second paint is not visible.

One embodiment is a camouflaged article having a surface and a first layer covering at least a portion of the surface. The first layer being a primer. The camouflaged article having a second layer covering at least a portion of the surface and a third layer covering a portion of the second layer. The second layer being paint and the third layer being paint in the form of a symbol, the third layer being a different color than the second layer. The camouflaged article having a camouflage ink layer covering at least a portion of the second layer and the third layer and a clear coat layer covering the camouflage ink layer. The symbol being visible at a first angular orientation of the surface and being substantially non-visible at a second angular orientation of the surface. The camouflage ink layer being visible at both the first angular orientation and the second angular orientation. The third layer may be a metallic paint or may be a mixture of metallic paint and pearl paint.

Figure 1:
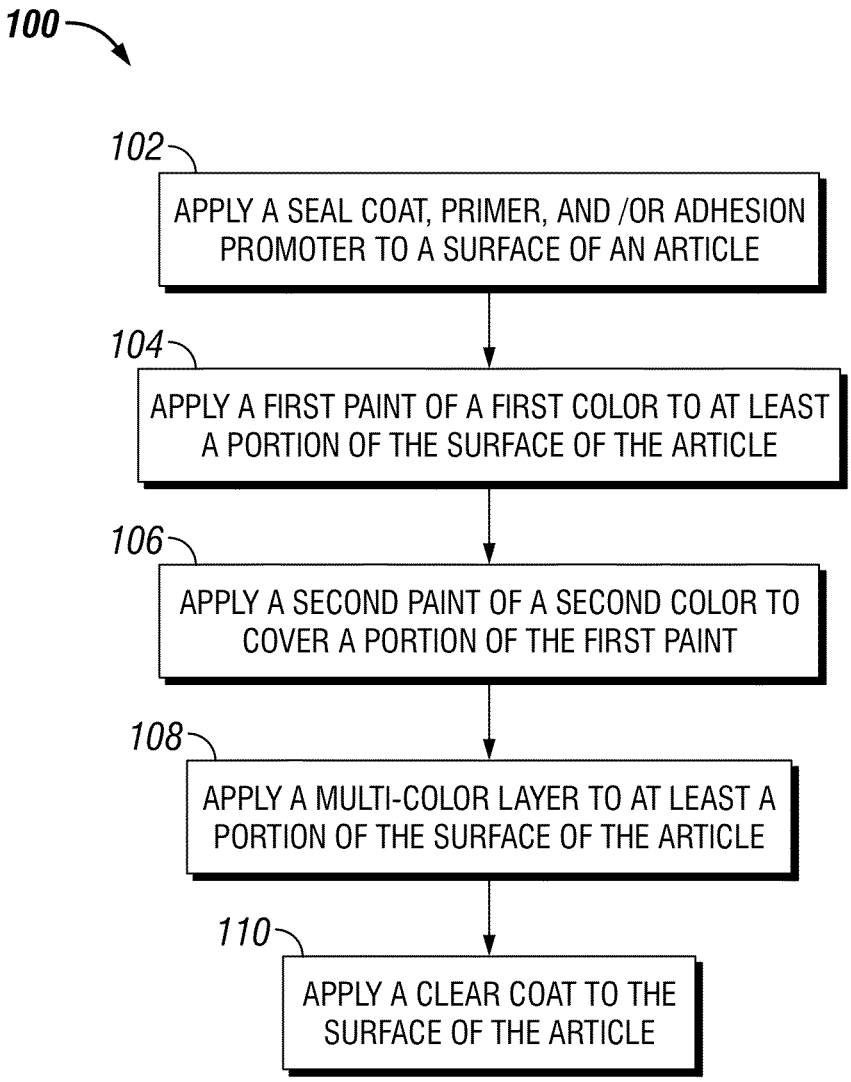
FIG. 1 is a flow diagram of one embodiment of a method of applying a camouflage system to a surface of an article.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

FIG. 1 is a flow chart of an embodiment of a method of applying a camouflage or multi-color branding system. The first step 102 is the application of an adhesion promoter which prepares the surface of an article so that paint will adhere to the surface. The adhesion promoter may be any substance, such as a primer and/or a seal coat, applied to the surface to promote the adherence of paint to the surface. Alternatively, the adhesion promoter may be integral to the surface of the article or the material of the surface may already promote adherence of paint and thus, an adhesion promoter not need to be applied to the surface.

A first layer of paint is then applied to at least a portion of the surface in step 104. The first layer of paint may preferably cover the entire surface of the article. The first layer of paint is a first color. The first color of the first layer of paint may be dictated by the multi-color layer to be applied in a later step. For example, most commercially available camouflage patterns that may be applied via water transfer printing indicate what base color should be used underneath the camouflage pattern so that the camouflage pattern after applied to an article has the intended appearance. The first layer of paint may be applied to the surface of an article using a spray gun, but various means of applying the first layer of paint could be used.

A second layer of paint is then applied on top of the first layer of paint in step 106. The second layer of paint is of a second color and only covers a portion of the first layer of paint. The second color of paint may contrast with the first color so as to be visually distinct from the first layer of paint. For example, the first layer of paint may be white whereas the second layer of paint may be red, which stands out and is highly visible on the first layer of paint. The second layer of paint may be applied in the form of a design, mark, logo, symbol, brand, word, slogan, image, and/or name (hereinafter collectively referred to as a "logo"). The second layer of paint provides for the application of a logo that will be covered by subsequent layer(s) and thus, incorporated into the multi-color layer that will be applied next. The second layer of paint may be applied to the surface of the article by spraying paint from a spray run through a stencil. However, other means may be used to apply the second layer of paint with or without the use of a stencil.

A multi-color layer is then applied to at least a portion of the surface in step 108. The multi-color layer covers the second layer of paint and at least a portion of the first layer of paint. The multi-color layer may preferably cover the entire surface of the article. The multi-color layer may be camouflage pattern or various other multi-color patterns such as a carbon fiber pattern. The multi-color layer alters the appearance of the second layer of paint since the multi-color layer is applied on top of the second layer of paint. Since the multi-color layer is not one uniform color, the visual appearance of the second layer of paint is not uniformly altered. For example, the second color may show through clear portions of the multi-color layer whereas other portions of the second layer of paint may appear to be of a different color due to the color of the multi-color layer positioned on top of the second layer of paint. As discussed in more detail below, the second layer of paint may become less visible or even non-visible depending on the viewing angle of the surface after the multi-color layer has been applied.

The multi-color layer may be applied using a water transfer printing process. As discussed above, the water transfer printing process is used to apply a multi-color layer, such as camouflage pattern, to the surface of an article, such as to the surface of components of a firearm. The multi-color layer may be an ink pattern formed onto a water soluble film or backing, such as a PVA based film. The water soluble film containing the ink pattern is placed onto the surface of a water bath causing the backing to dissolve leaving the multi-color layer of ink suspended on the surface of the water bath. An article may then be dipped into the water bath wherein the suspended multi-color ink pattern is transferred the surface of the article. A clear coat may then be applied in step 110 to protect the underlying layers.

Figure 2:
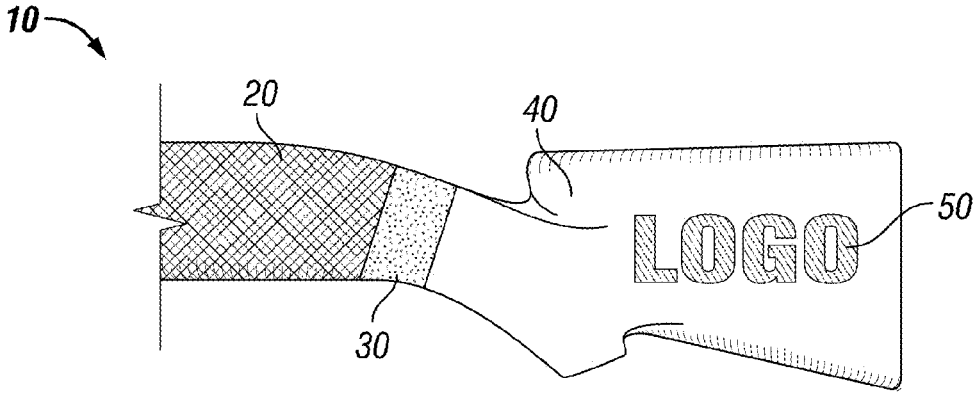
FIG. 2 is a side view of a surface of an article having the first three layers of one embodiment of a camouflage system applied to the surface.

FIG. 2 shows an article 10 with some layers of a multi-color layer or camouflage branding system on the surface 20 of the article. The article 10 is shown as a firearm stock for illustrative purposes only as the system and method disclosed herein may be applicable to various articles as would be appreciated by one or ordinary skill in the art having the benefit of this disclosure. As discussed above, an adhesion promoter 30 may be applied to the surface 20 of the article to promote adherence of paint to the surface. The adhesion promoter 30 may be any substance, such as a primer or seal coat, that prepares the surface prior to the application of paint. The article 10 may be comprised of a material that would eliminate the need of the application of an adhesion promoter.

A first layer of paint 40 may be applied to at least a portion of the surface 20 over the adhesion promoter 30. The first layer of paint 40 may cover the entire portion of the surface 20 on which the adhesion promoter 30 was applied. For illustrative purposes only, the first layer of paint 40 in FIG. 2 is shown not entirely covering the adhesion promoter 30. The first layer of paint 40 is a first color, which may be determined or dictated by the multi-color layer that is to be applied to the surface 20. For example, a specific camouflage pattern may dictate that the first layer of paint 40 be white.

A second layer of paint 50 is applied to cover a portion of the first layer of paint 40. The second layer of paint 50 is of a second color that differs from the first color of paint 40. The second color preferably is visually distinct from the first color so that the second layer of paint 50 can easily be distinguished from the first layer of paint 40 when viewed. The second layer of paint 50 may be formed in the form of a logo and may be positioned where desired on the first layer of paint. Multiple logos comprised of the second layer of paint 50 may be positioned on the first color of paint, if desired. The second layer of paint 50 provides that an article having a multi-color layer may be branded, customized, and/or personalized without the need to place a logo on top of the multi-color layer.

Figure 3:
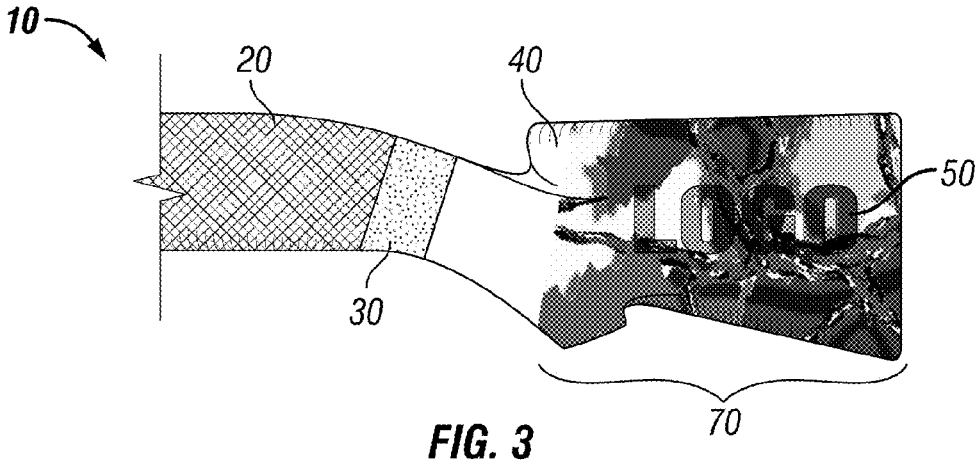
FIG. 3 is a side view of the article of FIG. 2 with a camouflage layer and clear coat applied to the surface.

FIG. 3 shows the article 10 of FIG. 2 with a multi-color layer and seal coat added to the surface 20 of the article 10. The multi-color layer in FIG. 2 is a camouflage pattern 70 that is applied over the first layer of paint 40 and second layer of paint 50. The camouflage pattern 70 may cover the entire surface of the article 10. As discussed above, the first layer of paint 40 and camouflage pattern 70 is shown not entirely covering the adhesion promoter 30 for illustrative purposes only. As shown in FIG. 3, the camouflage pattern 70 alters the visual appearance of the second layer of paint 50 as compared to FIG. 2. Due to the random nature of the camouflage pattern 70, the visual appearance of the second layer of paint 50 is not uniformly altered.

Figure 4:
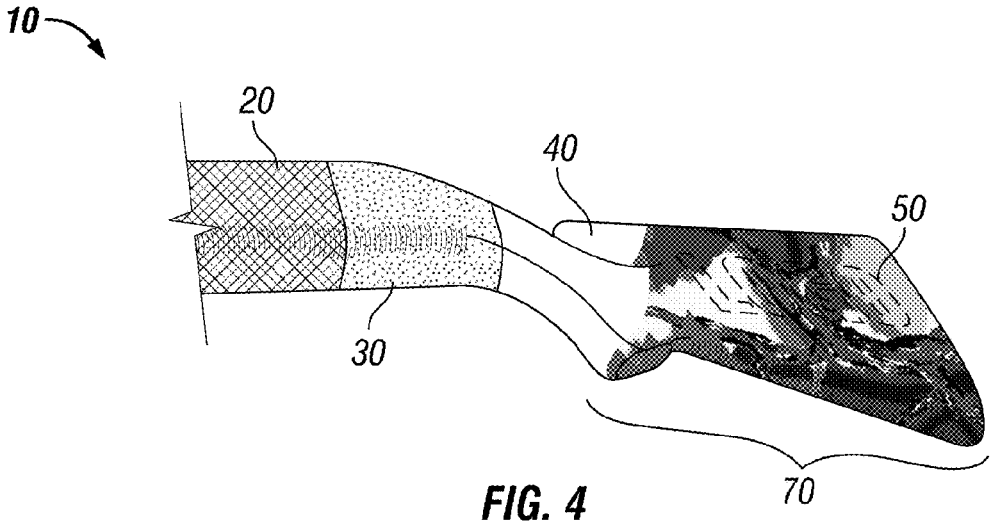
FIG. 4 shows a perspective view of the article of FIG. 3 at an angular orientation where the second layer of is less visible.

In one embodiment, the visibility of the second layer of paint 50 underneath the multi-color layer may change depending on the viewing angle of the article 10. For example, the second layer of paint 50 may be a metallic paint, mixture of metallic paint and pearl paint, or some other layer with reflective, refractive, diffractive, or diffusive light transmission properties, and the rotation or angular movement of the article 10 changes the appearance of the light being observed off of the second layer of paint 50. The change of visibility of the second layer of paint 50 is due to this change in the behavior of the observed light. FIG. 3 shows one orientation where the second layer of paint 50 is highly visible. FIG. 4 shows a perspective view of the article of FIG. 3 where the viewing angle has changed and the second layer of paint 50 is less visible. The use of various colors and types of paints underneath a multi-color layer may permit the second layer of paint 50 to have an intermittently visible, or "blinking," effect based on the orientation of the article. The "blinking" effect may be desirable to achieve a somewhat subliminal branding effect on potential consumers. The use of the second layer of paint 50 on the first layer of paint 40 permits the branding, marking, etc. of an article that has a multi-color layer, such as a camouflage layer, without obscuring the multi-color layer itself.

Figure 5:
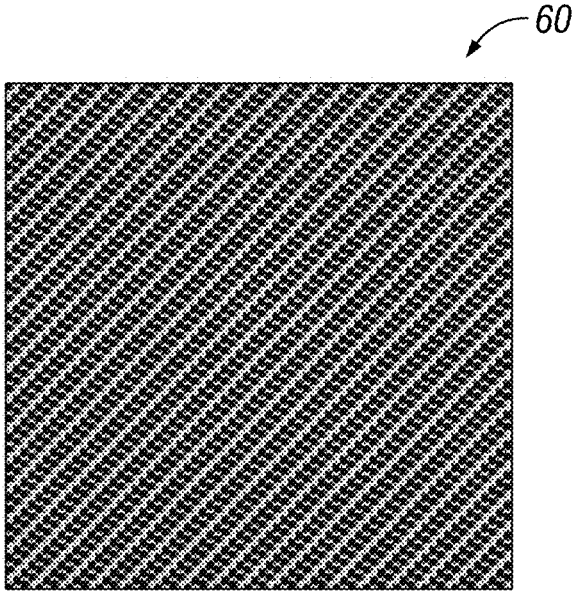
FIG. 5 shows an example of a camouflage layer.
Figure 6:
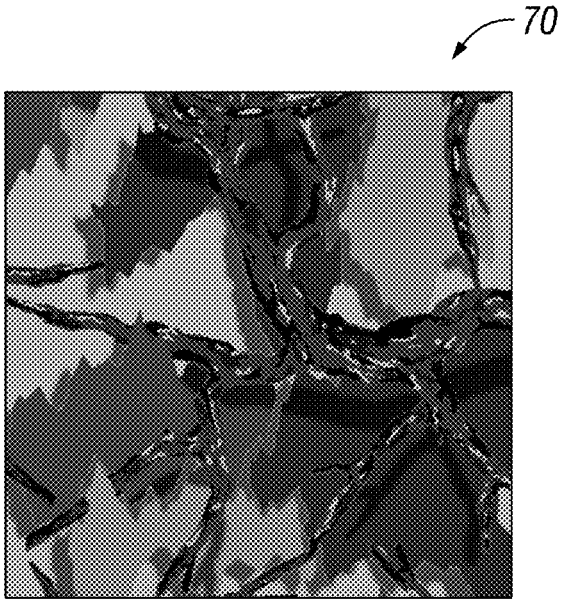
FIG. 6 shows an example of a multi-color layer.

FIG. 5 shows an example of a camouflage pattern 70 and FIG. 6 shows an example of a carbon fiber pattern 60, both of which are multi-color layers. The method and system of the present disclosure could be used with various patterns permitting an article to be branded, marked, personalized etc. without detracting, removing, and/or obscuring the pattern itself.

Although this invention has been described in terms of certain preferred embodiments, other embodiments that are apparent to those of ordinary skill in the art, including embodiments that do not provide all of the features and advantages set forth herein, are also within the scope of this invention. Accordingly, the scope of the present invention is defined only by reference to the appended claims and equivalents thereof

TABLE OF REFERENCE NUMERALS FOR FIGS. 1-6

10 an article
20 surface of article
30 adhesion promoter
40 first layer of paint
50 second layer of paint
60 carbon-fiber pattern multi-color layer
70 camouflage pattern multi-color layer
100 method of applying a camouflage system to a surface of an article
102 step of applying an adhesion promoter
104 step of applying a first paint being a first color
106 step of applying a second paint being a second color
108 step of applying a multi-color layer
110 step of applying a clear coat

What is claimed is:

1. A method of camouflaging an article, the method comprising:

applying a first paint of a first color to at least a portion of a surface of the article;

applying a second paint of a second color to cover a portion of the first paint, wherein the second paint comprises a metallic paint; and applying a layer of multiple colors to at least the portion of the surface of the article, the multi-color layer covering the second paint and the first paint not covered by the second paint;

wherein the second paint is visible when the article is positioned at a first viewing angle and wherein the second paint is not visible at a second viewing angle, the layer of multiple colors being visible at both the first and second viewing angles.

2. The method of claim 1, wherein the layer of multiple colors is applied by a water transfer printing process.

3. The method of claim 1, wherein the first color affects a visual appearance of the layer of multiple colors and the second color blocks the effects of the first color on the visual appearance of the layer of multiple colors.

4. The method of claim 3 further comprising:

applying a seal coat to the surface of the article prior to applying the first paint; and applying a clear coat to the surface of the article after applying the layer of multiple colors.

5. The method of claim 4, wherein the layer of multiple colors is a camouflage pattern.

6. The method of claim 5, wherein the application of the camouflage pattern alters a visual appearance of the second paint.

7. The method of claim 6, wherein the visual appearance is altered non-uniformly across the second paint.

8. The method of claim 5, wherein applying the layer of multiple colors further comprises:

dissolving a backing away from the layer of multiple colors; and dipping the surface of the article into ink comprising the layer of multiple colors, the ink being suspended on top of a water bath.

9. The method of claim 1, wherein applying the second paint further comprises applying the second paint through a stencil.

10. The method of claim 9 further comprising forming the stencil to comprise a design, mark, logo, brand, symbol, or name.

11. The method of claim 1, wherein the second color contrasts with the first color.

12. The method of claim 1, wherein the second paint has light reflective, refractive, diffractive, or diffusive properties.

13. The method of claim 1, wherein the second paint is a mixture of metallic paint and pearl paint.

14. A method of camouflaging an article, the method comprising:

applying a first layer on the surface of the article, the first layer being a primer or an adhesion promoter;

applying a second layer covering the entire first layer, the second layer being paint of a first color;

applying a third layer covering at least portion of the second layer, the third layer being a metallic paint of a second color;

applying via a water transfer printing process a fourth layer of multiple colors covering the second and third layers, wherein the third layer remains visible; and applying a fifth layer covering the fourth layer, the fifth layer being a clear coat; wherein the third layer is visible when the article is positioned at a first viewing angle and wherein the third layer is not visible at a second viewing angle, the fourth layer of multiple colors being visible at both the first and second viewing angles.

* * * * *